US006986273B2

(12) United States Patent
Rager

(10) Patent No.: US 6,986,273 B2
(45) Date of Patent: Jan. 17, 2006

(54) APPARATUS AND METHOD FOR OPENING AND CLOSING STACKED HYDROFORMING DIES

(75) Inventor: Christopher A. Rager, Womelsdorf, PA (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/601,219

(22) Filed: Jun. 20, 2003

(65) Prior Publication Data

US 2004/0255630 A1 Dec. 23, 2004

(51) Int. Cl.
*B21D 26/02* (2006.01)

(52) U.S. Cl. ..... 72/58; 72/61; 72/404; 72/455; 29/421.1

(58) Field of Classification Search ..... 72/58, 72/61, 62, 404, 421.1, 455, 456, 472; 29/421.1, 29/430

See application file for complete search history.

(56) References Cited

U.S. PATENT DOCUMENTS

| | | | | |
|---|---|---|---|---|
| 1,844,098 | A * | 2/1932 | Lytle | 72/60 |
| 2,222,762 | A * | 11/1940 | Debor et al. | 72/61 |
| 2,331,015 | A * | 10/1943 | Dawes et al. | 72/208 |
| 2,521,625 | A | 9/1950 | Benge | |
| 2,869,177 | A | 1/1959 | Jurgeleit | |
| 3,236,176 | A | 2/1966 | Fischer | 100/195 |
| 3,659,997 | A | 5/1972 | Rees | |
| 4,857,135 | A | 8/1989 | Copp | |
| 5,182,121 | A | 1/1993 | Miyashita et al. | |
| 6,170,309 | B1 | 1/2001 | Marando | |
| 6,284,101 | B1 | 9/2001 | Marx | |
| 6,386,009 | B1 | 5/2002 | Ni et al. | |

FOREIGN PATENT DOCUMENTS

| | | |
|---|---|---|
| DE | 27 23 848 | 12/1978 |
| DE | 195 25 085 | 1/1997 |
| JP | 2001 150048 | 6/2001 |

* cited by examiner

*Primary Examiner*—David Jones
(74) *Attorney, Agent, or Firm*—MacMillan, Sobanski & Todd, LLC

(57) ABSTRACT

A hydroforming apparatus for concurrently performing two or more hydroforming operations includes a frame that is sized to support hydroforming dies in a stacked relationship. Each of the dies includes a pair of cooperating die sections having respective recesses that define a die cavity. Guide pins and actuating cylinders, attached to platens on which the die section are supported, move in coordination with a ram and assist in moving die sections that are distant from the ram. When the die cavities are opened, hollow tubular blanks are inserted between the spaced apart die sections of the first and second die. Next, the ram and the support mechanism move such that the pairs of cooperating die sections of the first and second dies engage one another. End feed cylinders are then moved laterally into engagement with the end the tubular blanks to facilitate the filling thereof with a hydroforming fluid. The pressure of the fluid within the tubular blanks is then increased to expand such a magnitude that the tubular blanks are expanded outwardly into conformance with the respective die cavities. Thus, the hydroforming apparatus is capable of performing two or more hydroforming operations concurrently to decrease the overall amount of operation cycle time and to increase overall productivity.

5 Claims, 6 Drawing Sheets

APPARATUS AND METHOD FOR OPENING AND CLOSING STACKED HYDROFORMING DIES

BACKGROUND OF THE INVENTION

This invention relates to hydroforming operations. More particularly the invention relates to coordinated movement of dies used to perform concurrently two or more hydroforming operations in a press.

Hydroforming is a well known metal working process that uses pressurized fluid to expand a closed channel or tubular workpiece outwardly into conformance with the surface of a die cavity. A typical hydroforming apparatus includes a frame having two die sections supported for relative movement between opened and closed positions. The die sections have cooperating recesses, which together define a die cavity having a shape corresponding to a desired final shape for the workpiece. When moved to the open position, the die sections are spaced apart from one another to allow a workpiece to be inserted and removed from the die cavity. When moved to the closed position, the die sections are adjacent one another and enclose the workpiece within the die cavity. Although the die cavity is usually somewhat larger than the workpiece to be hydroformed, movement of the two die sections from the opened position to the closed position may, in some instances, cause some mechanical deformation of the workpiece. In any event, the workpiece is then filled with fluid, typically a relatively incompressible liquid such as water. Fluid pressure within the workpiece is increased to such a magnitude that the workpiece is expanded outward into conformance with the surface contour of the die cavity. As a result, the workpiece is deformed into the desired final shape. Hydroforming is an advantageous process for forming vehicle frame components and other structures because it can quickly deform a workpiece into a desired complex shape.

In a typical hydroforming apparatus, the two die sections are arranged such that a first die section is supported on a displaceable ram, while a second die section is supported on a immovable base. A mechanical or hydraulic actuator is provided for moving the ram and the first die section to the opened position relative to the base and the lower die section, thereby allowing a previously formed workpiece to be removed from the die cavity and a new workpiece to be inserted therein. The actuator also moves the ram and first die section to the closed position relative to the base and second die section before performing the hydroforming process.

Use of a single hydroforming die within a single hydroforming apparatus has been found to be somewhat inefficient from a time consumption standpoint. This is because each operational cycle performed by the hydroforming apparatus involves both a preliminary step of filling the article to be hydroformed with the fluid prior to performing the hydroforming process, and a subsequent step of emptying the hydroforming fluid from the article after performing the hydroforming process. These filling and emptying steps can consume relatively long periods of time, particularly when the articles to be formed are physically large, as is often the case in the manufacture of vehicle frame components. This inefficiency is amplified when the hydroforming apparatus is used to manufacture products in relatively high volumes, as is also the case in the manufacture of vehicle frame components. Thus, it would be desirable to provide an improved structure for a hydroforming apparatus that is capable of performing two or more hydroforming operations concurrently in order to decrease the operation cycle time and to increase overall productivity.

If multiple die cavities are arranged side-to-side in a horizontal configuration in a hydroforming press, the required press tonnage increases in proportion to the number of cavities. By positioning the die cavities in a stacked vertical arrangement in the press, the required press tonnage does not increase. The use of stacked dies allows multiple parts to be made using the same press tonnage as required to form a single part. It is desirable to provide an improved structure for a hydroforming apparatus that is capable of performing two or more hydroforming operations concurrently without increasing press tonnage.

Furthermore, when multiple dies are used to concurrently form parts n a single hydroforming operation, there is need to open the dies, to remove formed workpieces and to insert in the die cavities workpieces to be formed subsequently. Although a ram can assist an operator to open one die cavity, other die cavities not in direct contact with the ram cannot be opened by the ram. This deficiency increases process time and slows the production rate. It is preferable that each die cavity be opened and closed in a process coordinated with movement of the ram.

SUMMARY OF THE INVENTION

The invention relates to an improved apparatus and method for opening and closing dies that are used to concurrently performing two or more hydroforming operations. The apparatus includes a platen located between a stationary base and a ram that is linearly displaceable relative to the base. A platen, located between the base and the ram, is engageable with the ram so that they move as a unit at certain times during the operation and move separately at other times. Each of several dies, arranged in stacked relationship, includes a pair of cooperating die sections having respective recesses that define a die cavity.

A first die section of the first die is preferably mounted on or otherwise connected to the ram for movement therewith. A second die section of the first die is preferably connected to, or formed integrally with the first die section of the second die, and the combined assembly is preferably supported on the platen for movement therewith. The second die section of the second die is preferably connected to or formed integrally with the stationary base.

The ram is displaced relative to the platen and base a distance in a first direction sufficient to open the first die. Later the ram is displaced relative to the base an additional distance in the first direction sufficient to open the second die. A workpiece is inserted in each of the dies. Then the dies are closed by displacing the ram in a second direction opposite the first direction such that the pairs of cooperating die sections of the first and second dies engage one another. End feed cylinders are then moved laterally into engagement with the ends of the tubular blanks to facilitate filling the dies with a hydroforming fluid. The pressure of the fluid within the workpieces is then increased to such a magnitude that the workpieces expand outward into conformance with the surface of their respective die cavities.

In this way, the hydroforming apparatus performs two or more hydroforming operations concurrently to decrease process time and increase productivity without increasing press tonnage. The ram assists an operator to open both the dies that are adjacent the ram and other dies distant from the ram. Guide pins transmit certain portions of ram displacement to dies distant from the ram to assist in opening those dies. Linear actuators are used in coordination with the ram to assist in opening die cavities near the ram, and to move interior dies that cannot be opened directly by the ram. This feature reduces process time and further increases the production rate.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
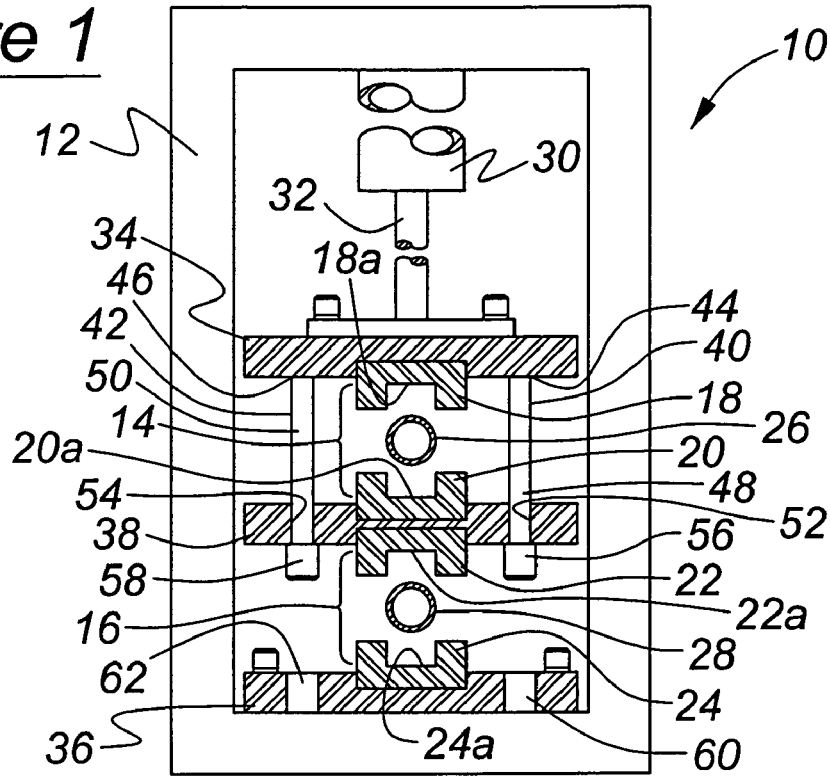
FIG. 1 is a side elevation view of a hydroforming apparatus according to this invention.

Referring now to the drawings, there is illustrated in FIG. 1 an apparatus, indicated generally at 10, for performing a hydroforming process in accordance with this invention. The apparatus 10 includes a frame 12 that is sized to support hydroforming dies arranged in a vertically oriented relationship, two of which are indicated generally at 14, 16. Although this invention will be described and illustrated in the context of the two vertically stacked hydroforming dies 14 and 16, it will be appreciated that this invention can be practiced with a greater number of such hydroforming dies if desired. Furthermore, the hydroforming dies can be arranged within the hydroforming apparatus 10 in any desired direction other than the illustrated vertical direction. For example, the dies may be stacked horizontally, in which case the lateral plane of the dies is vertical, and the direction of their movement is horizontal.

Figure 3A:
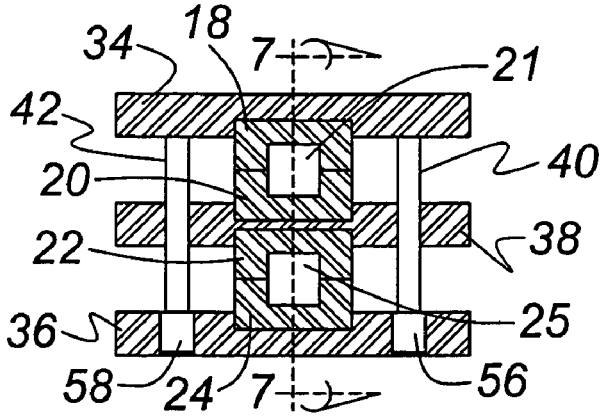
FIGS. 3A–3C are side elevational views showing a series of method steps employing the apparatus of FIGS. 1 and 2.

The first die 14 includes a first pair of cooperating die sections 18 and 20, which have respective recesses 18*a* and 20*a* formed therein. When the two die sections 18 and 20 are moved together as shown in FIG. 3A, the recesses 18*a* and 20*a* cooperate to define a first die cavity 21. Similarly, the second die 16 includes a second pair of cooperating die sections 22 and 24, which have respective recesses 22*a* and 24*a* formed therein. When the two die sections 22 and 24 are moved together as shown in FIG. 3A, the recesses 22*a* and 24*a* cooperate to define a second die cavity 25.

Frame 12 supports a ram or actuating cylinder 30, whose ram 32 is secured by bolts to a first platen 34, to which die section 18 is secured. In this way, reciprocating linear displacement of the ram 32 is transmitted directly to die section 18 of the first die 14. A base 36, fixed to the frame 12 against displacement, supports a die section 24 of the second die 16 in alignment with the other die sections, which are mutually aligned.

Figure 2:
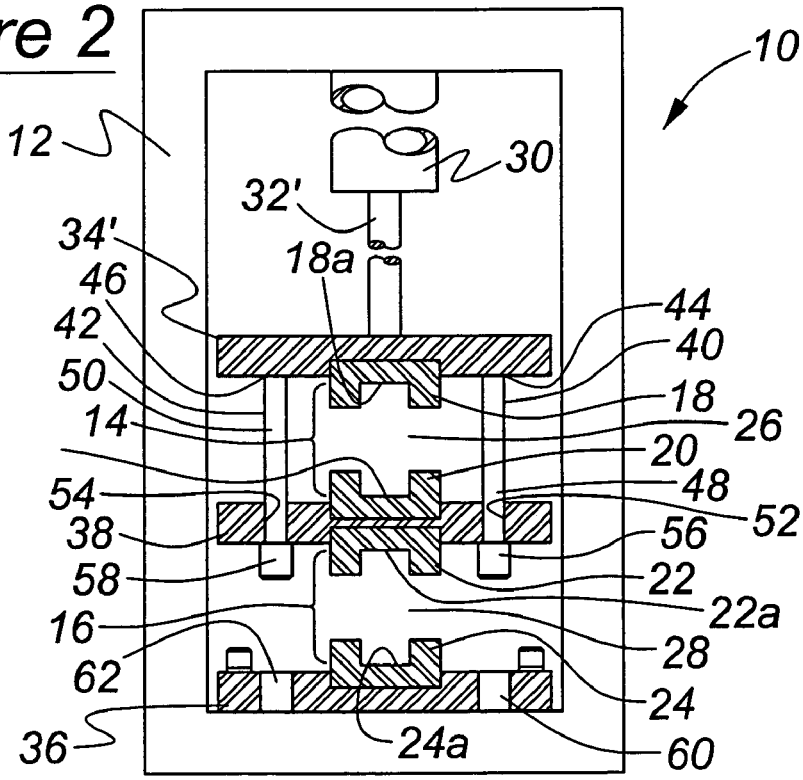
FIG. 2 is another hydroforming apparatus according to this invention, in which a platen is formed integrally with the ram.

FIG. 2 shows an alternative arrangement in which a ram 32' is in the form of a platen, and die section 18 is secured to the ram 32'. Reciprocating linear displacement of ram 32' is transmitted directly to die section 18 of the first die 14. Although this invention is described and illustrated in the context of apparatus including a platen 34 and a ram 32, it will be appreciated that this invention can be practiced with the arrangement of FIG. 2, in which the ram 32 and platen 34 are in the form of an integral, unitary ram 32', if desired.

The first die section 18 of the first die 14 is preferably secured to a portion of the hydroforming apparatus, platen 34, for linear displacement therewith. The second die section 20 of the first die 14 and the first die section 22 of the second die 16 are secured to a platen 38 for movement therewith. Alternatively, if the second die section 20 of the first die 14 and the first die section 22 of the second die 16 are formed as separate pieces, then each may be supported on individual platens, and those platens are secured mutually for movement as a unit. Lastly, the second die section 24 of the second die 18 is preferably secured to or formed integrally with a second portion of the hydroforming apparatus 10, the stationary base 36.

Platen 34 supports guide pins 40, 42 which are secured at connections 44, 46 to the lower surface of platen 34. The connection of the guide pins to the platen 34 may be accomplished by a weld, by mutual engagement of screw threads formed on pins 40, 42 and in platen 34, by bolting each guide pin to the platen, by pinning the guide pins to the platen, or by similar means. Each guide pin is formed with a shank portion 48, 50 that extends from its respective connection 44, 46 through a opening 52, 54 formed through the thickness of the second platen 38 to a head 56, 58, located on the opposite side of platen 38 from the location of platen 34. Each head is sized in relation to the size of the corresponding opening 52, 54 so that the head contacts and releasably engages platen 38 when displacement of platen 34 relative to platen 38 reaches a predetermined magnitude in one direction.

When platen 34 moves toward platen 38 in the opposite direction a sufficient distance, each head 56, 58 can enter an opening 60, 62 formed in the thickness of base 36. Preferably the fit of each the shank 48, 50 in its corresponding opening 52, 54, and the fit of each head 56, 58 in its corresponding opening 60, 62 is a guided fit that assures mutual alignment of the platens 34, 38, base 36, and dies 14, 16.

Figure 3B:
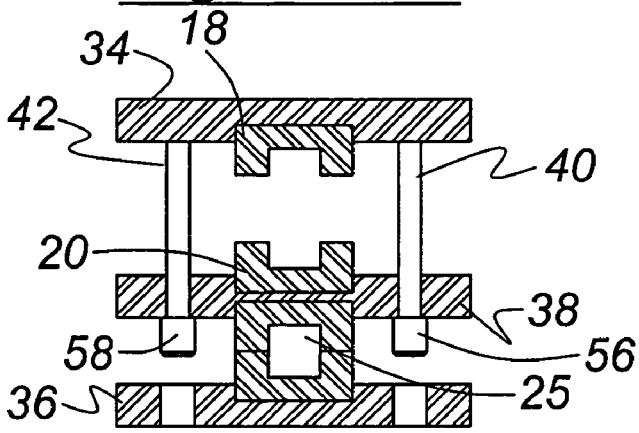
Figure 3C:
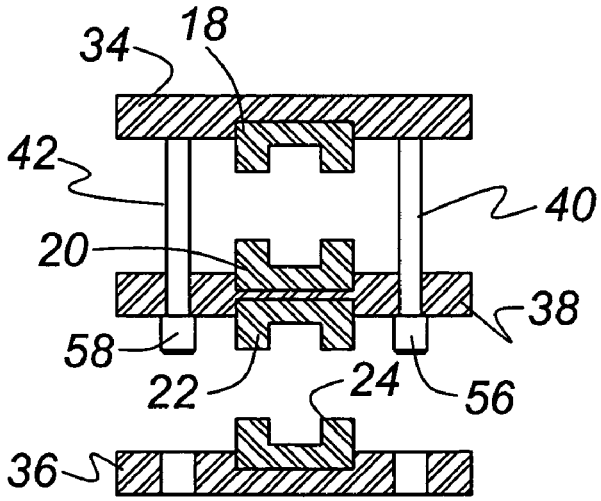

During series production of parts using the hydroforming apparatus 10, an operational cycle begins with the various components arranged in the die closed position of FIG. 3A, in which the die cavities 21, 25 are occupied with parts formed during the prior cycle. Die cavity 21 is opened when ram 32 moves upward due to actuation by its cylinder 30. Platen 34 moves upward with the ram, and the heads 56, 58 of guide pins 40, 42 engage the lower surface of platen 38, as FIG. 3B shows. This upward displacement of ram 32 fully opens die 14 without opening the second die 16. Then, ram 32 moves upward again due to actuation by its cylinder, platen 32 moves upward with the ram, and platen 38 moves upward with the ram due to contact of the heads 56, 58 on the lower surface of platen 38, thereby opening die cavity 25, as FIG. 3C shows. Preferably the length of the shank portions 48, 50 of the guide pins 40, 42 is a predetermined length that enables die cavity 21 to be opened sufficiently to remove formed parts from the die and to insert workpieces in the die readily within the available extent of travel of the ram 32.

Next, the formed parts located in the die cavities 21, 25 are removed, a workpiece 26 is inserted between the spaced apart die sections 18 and 20 of the first die 16, and another workpiece 28 is inserted between the spaced apart die sections 22 and 24 of the second die 18. The illustrated workpieces 26 and 28 are substantially circular in cross-sectional shape. However, it should be understood that the invention is not limited to any specific shape of the workpieces 26 and 28, and that the invention can be practiced using workpieces of any shape, provided they can be located within their respective die cavities 21 and 25 prior to the hydroforming operation.

Figure 4A:
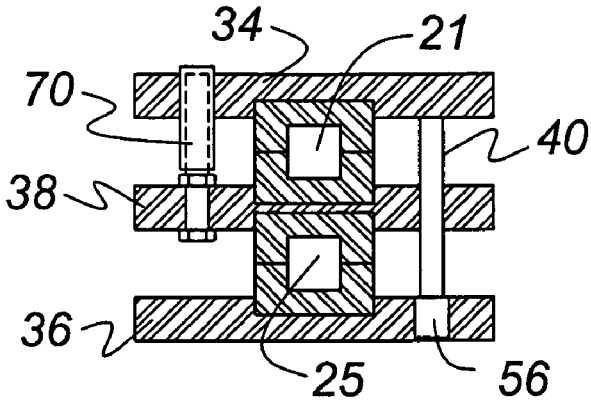
FIGS. 4A–4C are side elevational views showing a series of method steps employing another embodiment of the present invention.
Figure 4B:
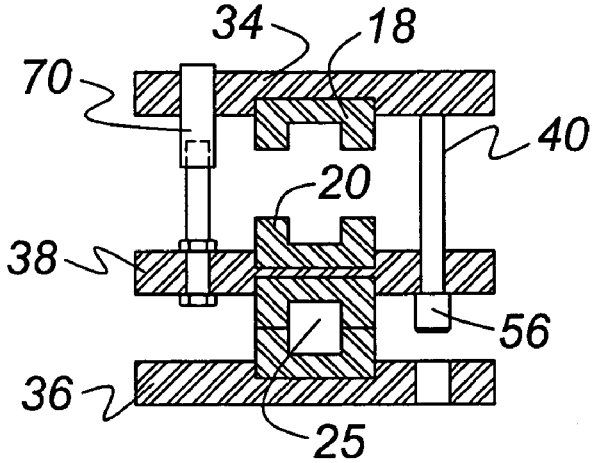
Figure 4C:
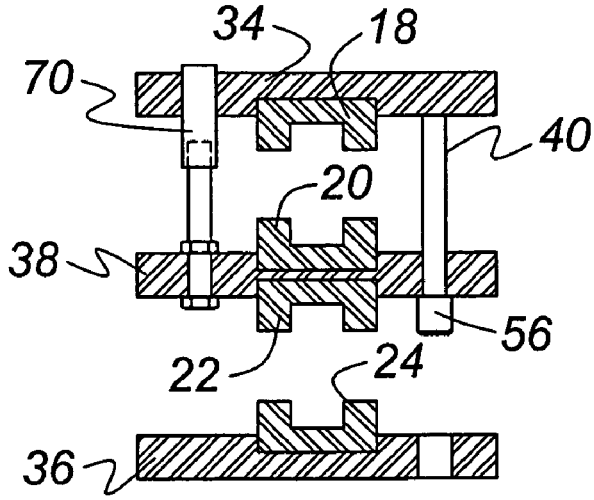

FIGS. 4A–4C illustrate another embodiment in which a linear actuator 70 is secured to the first platen 34 and intermediate platen 38. Actuator 70 is secured to platen 38 by bolts and is also secured to platen 34 so that forces, directed up ward and downward and produced by ram 32 and actuator 70, are transmitted to platens 34, 38. The actuator 70 may be hydraulically, pneumatically or electrically actuated. A hydraulic linear actuator is generally in the form of a double acting piston movable within a hydraulic cylinder. Pressurized fluid is applied within the cylinder alternately to opposite sides of the piston depending on the direction the piston is to be moved relative to the cylinder. The piston is displaced, and the actuator transmits a force to the components to which the cylinder and piston are secured.

FIG. 4A shows die cavities 21, 25 closed, linear actuator 70 fully retracted, and guide pin 40 in its lowermost position. Next, ram 32 moves upward, raising platen 34 and opening die cavity 21. Actuator 70 may assist in opening die cavity 21 by applying a force on platens 34, 38. When the die cavity 21 is opened, head 56 of die pin 40 contacts the lower surface of platen 38. Next, ram 32 again moves upward carrying platens 34, 38 upward and opening die cavity 25. After the formed parts are removed from the dies 14, 16 and workpieces to be formed are inserted in the dies, ram 32 lowers platens 34, 38, preferably with the assistance of force produced by actuator 70, until die section 22 engages and seats on die section 24, thereby closing die cavity 25. Ram 32 continues to move downward to the position of FIG. 4A, where both die cavities 21, 25 are closed preparatory to pressurizing the die cavities and the workpieces to be formed within the cavities.

Figure 5A:
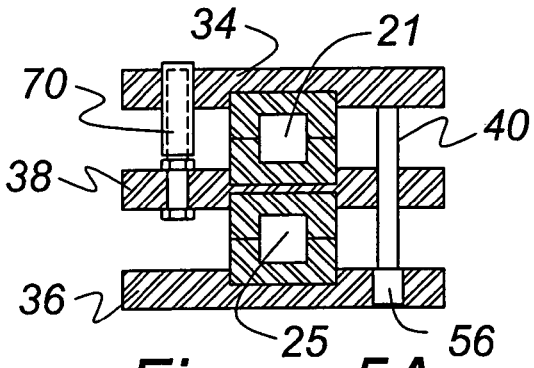
FIGS. 5A–5D are side elevational views showing a series of method steps employing another embodiment of the present invention.
Figure 5B:
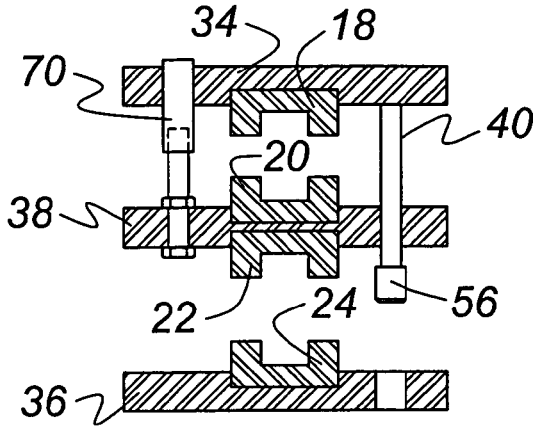
Figure 5C:
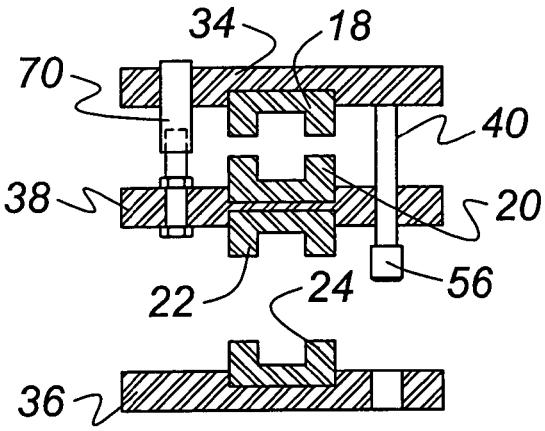
Figure 5D:
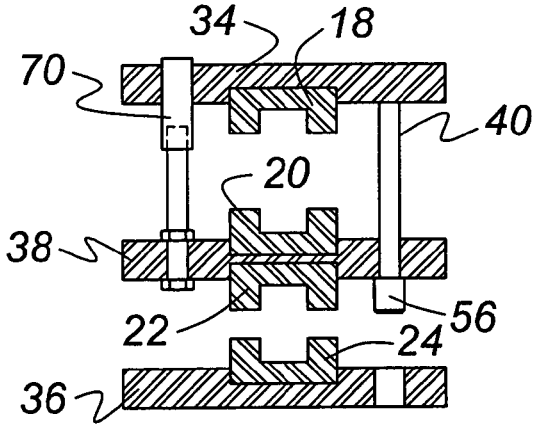

Use of the embodiment described with reference to FIGS. 4A–4C is described next with reference to FIGS. 5A–5D, in which a space between die sections is adjusted through operation of the linear actuator 70 to assist in removal of formed parts from the die cavities. From the position of the hydroforming apparatus shown in FIG. 5A where die cavities 21, 25 are fully closed, ram 32, alone or in combination with actuator 70, moves platen 34 upward to the position of FIG. 5B, where the upper die cavity and the lower die cavity 21, 25 are partially open. In this case, the head 56 of guide pin 40 is not in contact with the intermediate platen 38; therefore, actuator 70 applies a force that moves platen 38 upward to the position of FIG. 5B from the closed position of FIG. 5A. Next, the position of upper platen 34 is substantially maintained, and platen 38 is raised by actuator 70 to a position sufficient to fully open the lower die cavity 25, the position shown in FIG. 5C. This displacement of platen 38 further partially closes the upper die cavity 21. With the apparatus located as shown in FIG. 5C, a formed part can be removed from die cavity 25 and a workpiece can be inserted in the lower die cavity. Next, actuator 70 extends its length, lowering platen 38, fully opening the upper due cavity 21, and partially closing the lower die cavity 25. Contact between the head 56 and the lower surface of platen 38 provides a visual indication that actuator 70 has been extended sufficient to fully open the upper die cavity 21, the position shown in FIG. 5D. Then the formed part is removed from the upper die cavity 21 and a workpiece to be hydroformed is installed in the upper die cavity. Next, ram 32 is lowered and carries platens 34, 38 downward. Actuator 70 retracts until the apparatus returns to the position of FIG. 5A, where the head 56 enters the opening in base 36, and die cavities 21 and 25 are fully closed. Thereafter, hydroforming fluid fills the die cavities and the cavities are pressurized to force the workpieces into contact with the inner surface of the die cavities, as is described with reference to FIG. 7.

Figure 6A:
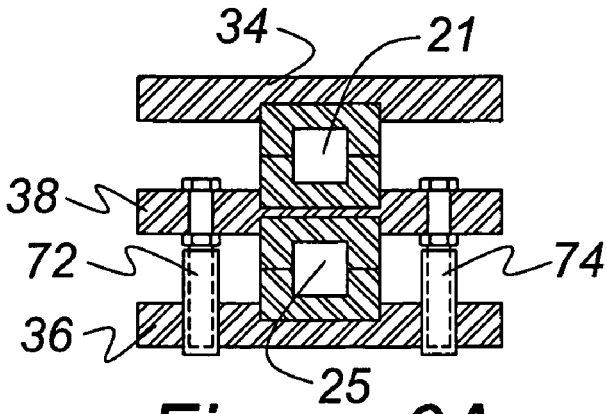
FIGS. 6A–6C are side elevational views showing a series of method steps employing another embodiment of the present invention.
Figure 6B:
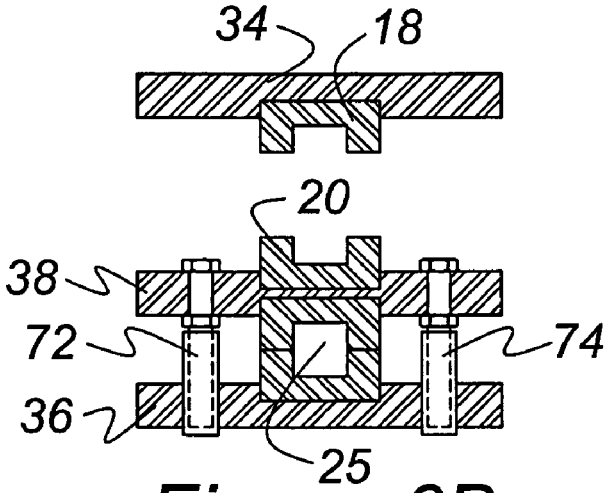
Figure 6C:
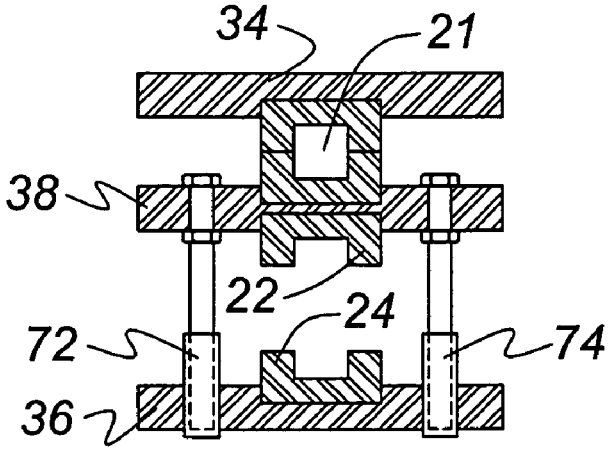

FIGS. 6A–6C show another arrangement of the hydroforming apparatus with the guide pins removed, a first linear actuator 72 secured to platen 38 and base 36, and a second linear actuator 74 secured to platen 38 and base 36. FIG. 6A shows the apparatus in a closed die position. Ram 32 moves platen 34 upward to the position of FIG. 6B, where the upper die cavity 21 is fully opened. Actuators 72, 74 are fully retracted and the intermediate platen 38 is maintained in the lowermost position with die cavity 25 closed. The hydroformed parts are removed from the upper die cavity 21 and workpieces to be hydroformed are placed in the upper die cavity. Then actuators 72, 74 are extended, raising platen 38 to the position shown in FIG. 6C, where the upper die 14 is closed and the lower die 16 is fully opened. Hydroformed parts are then removed from the lower die cavity 25 and a workpiece to be hydroformed is placed in the lower die cavity. Ram 32 is lowered while maintaining die cavity 21 closed and forcing platen 38 downward, either with the assistance of actuators 72, 74 or without that assistance. Ram 32, platen 34 and platen 38 continue to move downward until die section 22 become fully retracted.

Preferably the available length of travel of the linear actuators 70, 72, 74 enables die cavities 21, 25 to be opened sufficiently to remove and insert workpieces readily within the available extent of travel of the ram 32.

The workpieces 26, 28 can be manufactured in any conventional manner, such as by rolling a sheet of metallic material into a completely closed tubular configuration and welding the adjacent edges together. Alternatively, the workpieces 26 and 28 can be manufactured as seamless tubes. If desired, the workpieces 26 and 28 can be mechanically pre-bent prior to insertion within the first and second dies 16 and 18 so as to approximate the desired final shapes. It will be appreciated that the two die cavities 21 and 25 can be configured to form the workpieces 26 and 28 into either the same shape or into two different shapes, as desired.

After the workpieces are inserted into their respective die cavities 21 and 25, the ram 32 and platens 34, 38 move downwardly relative to the base 36 to the closed position illustrated in FIG. 3A, and the guide pin heads 56, 58 reenter the openings 60, 62 in the base 36. During such closing movement of the first and second dies 16 and 18, portions of the workpieces 26 and 28 may be mechanically deformed somewhat, although such is not required. When the ram 30 reaches the lowermost position illustrated in FIG. 3A, the dies 14 and 16 are disposed in a stacked relationship between the ram 32 and the base 36. As used herein, the term "stacked relationship" means that the cooperating die sections of each of the dies engage one another, and further that the adjacent die sections of different dies engage one another. Thus, in the illustrated embodiment, the first pair of cooperating die sections 18 and 20 of the first die 14 engage one another, the second pair of cooperating die sections 22 and 24 of the second die 16 engage one another, and the second die section 20 of the first die 14 engages the first die section 22 of the second die 18. At that time, a conventional clamping mechanism (not shown) can be engaged so as to maintain the die sections 18 and 20 of the first die 14 and the die sections 22 and 24 of the second die 18 in the illustrated stacked relationship. Alternatively, if the hydroforming apparatus 10 is adapted from a conventional mechanical press, the ram 32 can function as the clamping mechanism by moving to its bottom dead center position illustrated in FIG. 3A, thereby holding or otherwise maintaining the die sections 18 and 20 of the first die 14 and the die sections 22 and 24 of the second die 18 in the illustrated stacked relationship.

Figure 7:
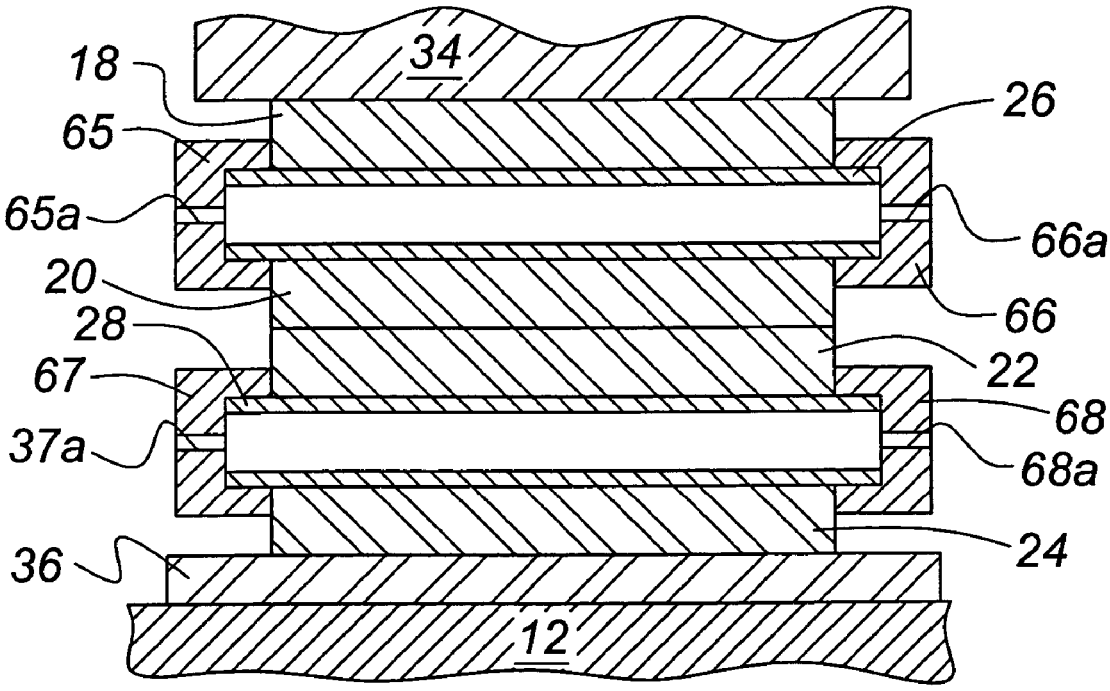
FIG. 7 is a side elevation cross sectional view of a portion of the hydroforming apparatus taken along plane 7—7 of FIG. 3A.

Referring now to FIG. 7, a first pair of end feed cylinders 65 and 66 are then moved laterally into engagement with the ends of the first workpiece 26, while a second pair of end feed cylinders 67 and 68 are moved into engagement with the ends of the second workpiece 28. The end feed cylinders 65–68 have respective passageways 65*a*, 66*a*, 67*a*, and 68*a* formed therethrough to facilitate filling the workpieces 26 and 28 with a hydroforming fluid, typically a relatively incompressible liquid such as water, and emptying that fluid. The illustrated end feed cylinders 65–68 are intended to be representative of any mechanism or mechanisms for sealing the ends of the workpieces 26 and 28, for supplying pressurized hydroforming fluid into the interiors of the workpieces 26 and 28, and for emptying hydroforming fluid from the interiors of the workpieces 26 and 28 at the conclusion of the hydroforming process.

In the next step of the hydroforming method, the pressure of the fluid within the workpieces 26 and 28 is increased to such a magnitude that the workpiece 26 expands outward into engagement with the surface of the recesses 18*a* and 20*a* formed in the first and second die sections 18 and 20 of the first die 16, and the second workpiece 28 is expanded outwardly into engagement with the surface of the, recesses 22*a* and 24*a* formed in the first and second die sections 22 and 24 of the second die 18. Such expansion causes the workpieces 26 and 28 to conform to the contour of the surfaces of die cavities 21 and 25, respectively.

Preferably, a single source provides pressurized fluid to each of the workpieces 26 and 28 at the same time so that the respective hydroforming processes can be performed substantially simultaneously at the same pressures. As a result, the hydroforming apparatus 10 is capable of performing two or more hydroforming operations concurrently to decrease the overall amount of operational cycle time and, therefore, increase overall productivity. However, the hydroforming processes are essentially independent of one another and, therefore, can be performed with differing parameters, including times, pressures, and the like, if desired.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A hydroforming apparatus comprising:

a ram adapted to support a first section of a first die thereon;

a base adapted to support a first section of a second die thereon;

an intermediate platen located between said ram and said base and adapted to support a second section of the first die and a second section of the second die thereon, said intermediate platen being movable relative to said ram between a closed position and an opened position and being movable relative to said base between a closed position and an opened position;

an actuator extending between said ram and said intermediate platen for selectively positioning said intermediate platen in said closed and opened positions relative to said ram; and a pin extending between said ram and said intermediate platen for selectively positioning said intermediate platen in said closed and opened positions relative to said base.

2. The hydroforming apparatus defined in claim 1 wherein intermediate platen has an opening formed therethrough, and wherein said pin extends through said opening.

3. The hydroforming apparatus defined in claim 2 wherein said pin has a head that is located between said intermediate platen and said base.

4. The hydroforming apparatus defined in claim 3 wherein said head is larger than said opening formed through said intermediate platen.

5. The hydroforming apparatus defined in claim 3 wherein said base has an opening formed therein that is sized to receive said head of said pin therein.

* * * * *